US005172440A

United States Patent [19]

Ming

[11] Patent Number: 5,172,440

[45] Date of Patent: Dec. 22, 1992

[54] QUILT BAG

[76] Inventor: Wu L. Ming, No. 9, Lane 117, Chien Chung Street, Chia Li Chen, Tainan Hsien, Taiwan

[21] Appl. No.: 914,010

[22] Filed: Jul. 15, 1992

Related U.S. Application Data

[63] Continuation of Ser. No. 727,437, Jul. 9, 1991, abandoned.

[51] Int. Cl.[5] ..... A47G 9/00

[52] U.S. Cl. ..... 5/485; 5/417; 5/419; 5/420

[58] Field of Search ..... 5/413, 417, 420, 419, 5/482, 485

[56] References Cited

U.S. PATENT DOCUMENTS

| | | | |
|---|---|---|---|
| 2,183,418 | 12/1939 | Williams | 5/420 X |
| 2,344,010 | 3/1944 | Walsh | 5/417 X |
| 4,164,275 | 8/1979 | Davis | 5/417 X |
| 4,375,111 | 3/1983 | Hall | 5/420 X |
| 4,774,734 | 10/1988 | Mills | 5/413 |
| 4,856,131 | 8/1989 | Mills | 5/413 |

FOREIGN PATENT DOCUMENTS

| | | | |
|---|---|---|---|
| 644754 | 8/1984 | Switzerland | 5/413 |

*Primary Examiner*—Michael F. Trettel
*Attorney, Agent, or Firm*—Bacon & Thomas

[57] ABSTRACT

A quilt bag comprising a frontal section patterned after a toy and sewn to a cover of a quilt and integral with flap or back section equal in size to the frontal section and a zip-fastener affixed to margins of the frontal and back sections to zip close a bag constituted with the frontal and back sections for loading the quilt in good order and appearance.

1 Claim, 5 Drawing Sheets

QUILT BAG

This application is a continuation Ser. No. 07/727,437, filed Jul. 9, 1991 now abandoned.

BACKGROUND OF THE INVENTION

The present invention relates to bags and, more particularly, to bags for packing quilts and the like.

Household sleeping sets such as quilts, blankets and sleeping bags are used in extended condition. These bed coverings are foldable into a roll or other proper shapes for storage. As these bed coverings are bulky, they can only be loosely folded and are not in good order for room arrangement and carrying.

SUMMARY OF THE INVENTION

An objective of the present invention is to provide a bag sewn to the outer surface or cover of a quilt, blanket or sleeping bag for packing them into a compact size and showing a pleasant appearance.

According to the present invention, a bag having a frontal section or outer cover decorated with a pattern is sewn to the frontal cover of a quilt, blanket or sleeping bag and includes a back section or flap which is equal in size to the frontal section. The frontal section and the back section are connected with a complementary pair of slide fastener parts and slider or zipper to form an envelope for receiving a quilt, blanket or sleeping bag.

DETAILED DESCRIPTION OF THE PREFERRED EMBODIMENT

Figure 1:
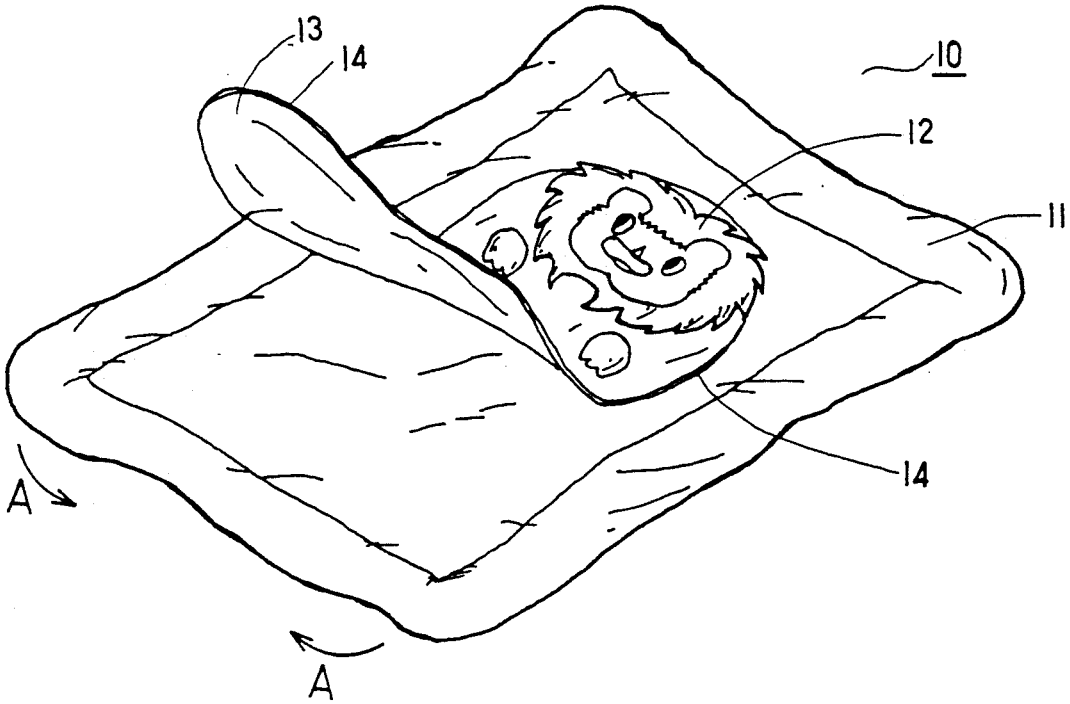
FIG. 1 is a perspective view which illustrates a first embodiment of the present invention with that embodiment in an extended condition.

Referring to FIG. 1, a quilt bag referred to generally by numeral 10 comprises a frontal section in the form of a toy lion, i.e., patterned after a lion, sewn to the middle of a frontal portion of a cover of a quilt 11 and with an integral back or flap section 13 equal in size to and extending from the frontal section 12. The bag 10 also includes a complementary pair of slide fastener parts 14 and slider 140 which form a zip-fastener. One slide fastener 14 is affixed to the margin of the frontal section 12 and the other slide fastener part 14 is affixed to the margin of the flap section 13 so as to zip to open or close a bag which is formed by the frontal section 12 and the flap section 13.

Figure 2:
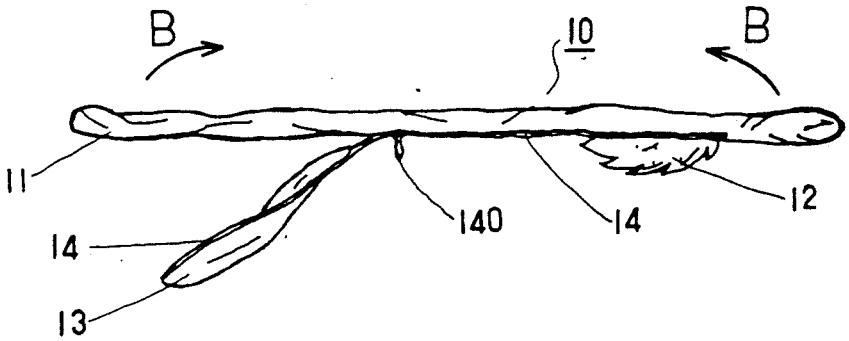
FIG. 2 is a side-elevational view of the first embodiment which is positioned upside-down and with the lateral portions thereof folded over.
Figure 3:
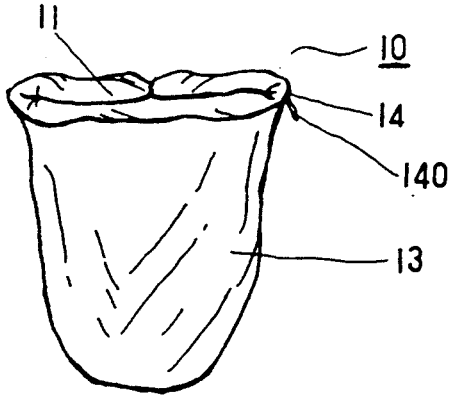
FIG. 3 is a front-elevational view which illustrates the first embodiment as shown in FIG. 2.
Figure 4:
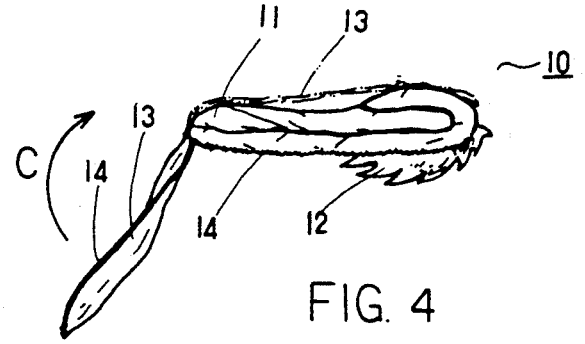
FIG. 4 is a side elevation of the first embodiment with the front and rear portions folded over.
Figure 5:
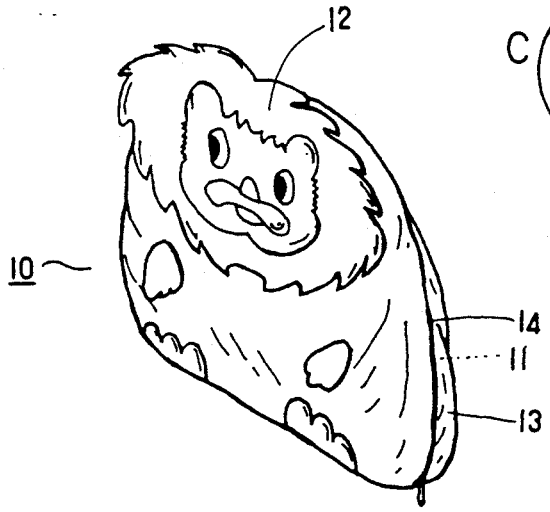
FIG. 5 is a perspective view of the first embodiment of the invention in its packed condition.

In the utilization of the first embodiment of the present invention as shown in FIGS. 1 through 4, the quilt 11 is first turned upside-down and the lateral portions of the quilt 11 are folded over along arrows A (as shown in FIG. 1) into a shape as best shown in FIGS. 2 and 3. The frontal and rear portions are then folded over along arrows B (as shown in FIG. 2) into a shape as best shown in FIG. 4. In this condition of the quilt 11, the flap section 13 is positioned in place over the rear and top side of the quilt 11 to form a bag to envelop the folded quilt 11. The bag is then zipped closed to pack the quilt 11 therein. The quilt 11 can thus be packed in good order and with the pleasing appearance of a toy lion.

Figure 7:
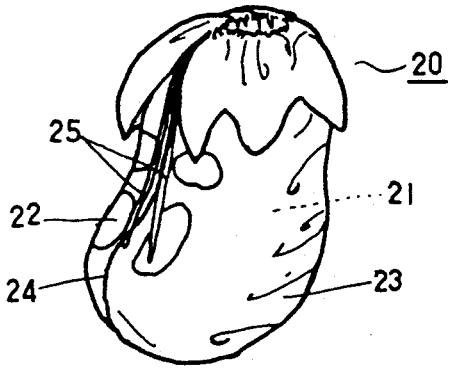
FIG. 7 is a perspective view which illustrates the second embodiment of the invention in a packed condition.
Figure 6:
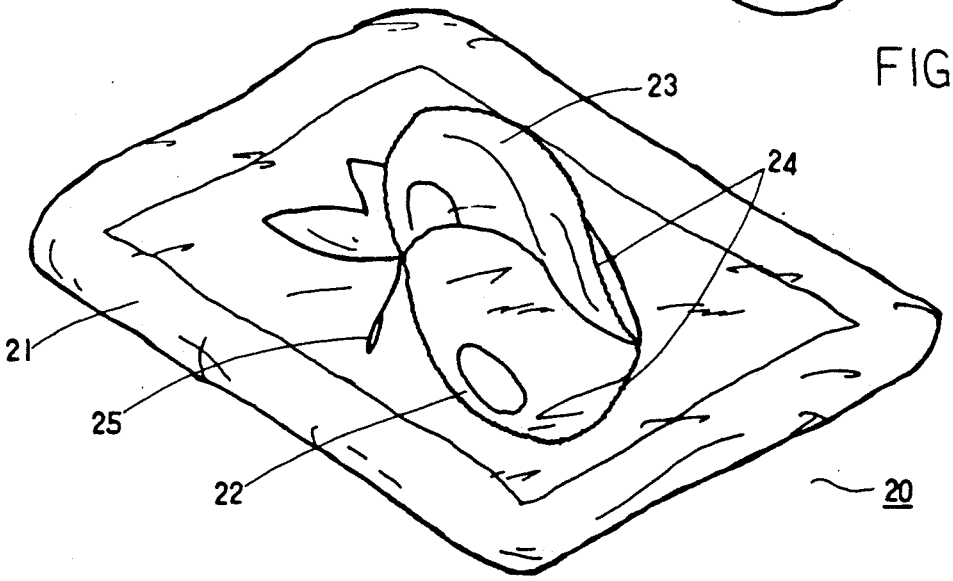
FIG. 6 is a perspective view of a second embodiment which is in an extended condition.

Referring to FIGS. 6 and 7, a second embodiment of a quilt bag is referred to generally by numeral 20. In this embodiment, the quilt bag is in a form of a squash toy and comprises a frontal section 22 which is sewn to the middle of a frontal portion of a cover of a quilt 21 and integral with a back or flap section 23 equal in size to and connected to the frontal section 22. A complementary pair of slide fastener parts 24 are fixed along the margins of the frontal and flap sections 22, 23 to zip close the quilt bag of the second embodiment with a slider (not shown) so as to pack the quilt 21 therein. The quilt bag 20 is then further secured in place by tie cords 25 and results in a package with the appearance of a toy squash as shown in FIG. 7.

The embodiments described above are quilt bags for packing quilts only. It is to be noted that the quilt bags of the present invention are suitable for packing similar bed-coverings, such as blankets and sleeping bags.

Figure 8:
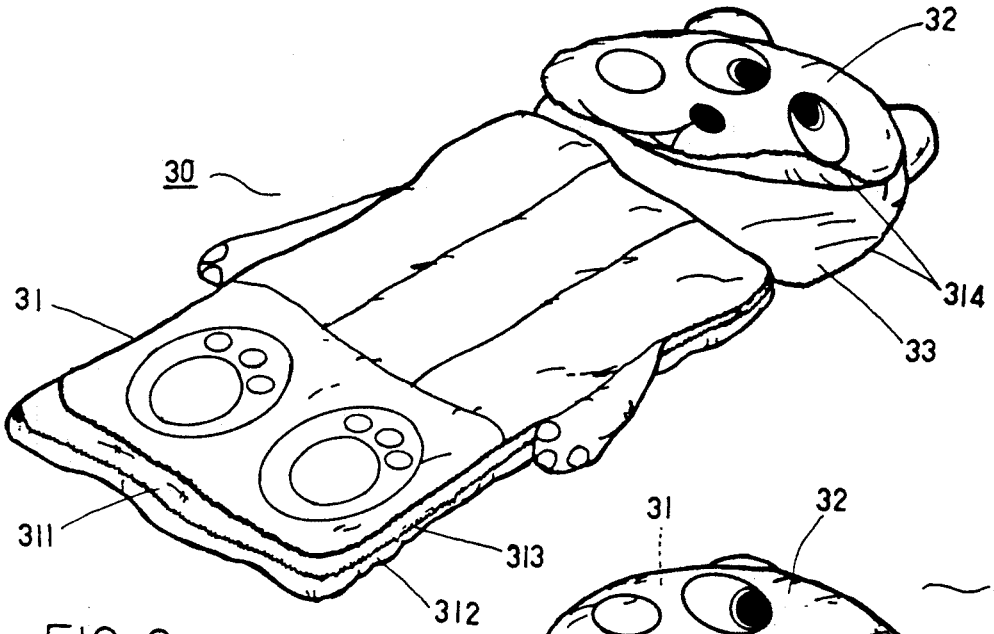
FIG. 8 is a perspective view which illustrates a third embodiment of the invention in an extended condition.
Figure 9:
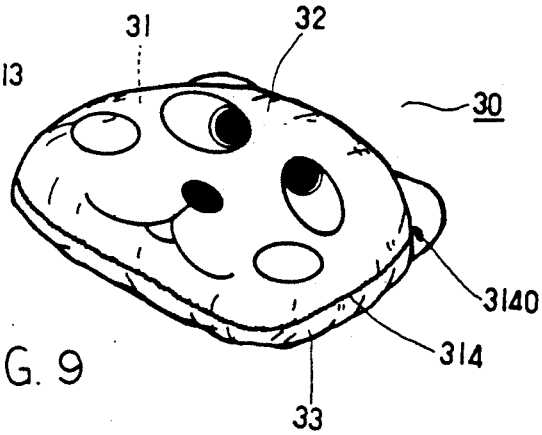
FIG. 9 is a perspective view of the third embodiment of the invention which is in its packed condition.

Referring to FIG. 8, a third embodiment of a quilt bag referred to generally by numeral 30 is in a form of a toy panda. The bag comprises a conventional sleeping bag of two stacking layers 311, 312 fastened together by a zip-fastener 313. A back section 33, with one side attached to the front end of the sleeping bag 31, and a flap section 32 attached to the leading or front end of the back section 33 are provided for opening the sleeping bag 31 or for rolling or folding the sleeping bag 31 into the bag of this embodiment. A complementary pair of slide fastener parts 314 are affixed as shown along the margins of the back section 33 and flap section 32 to zip close the bag of the third embodiment with a slider 314 so as to pack the sleeping bag therein in good order and with a pleasing appearance of a panda toy face as best shown in FIG. 9.

Figure 10:
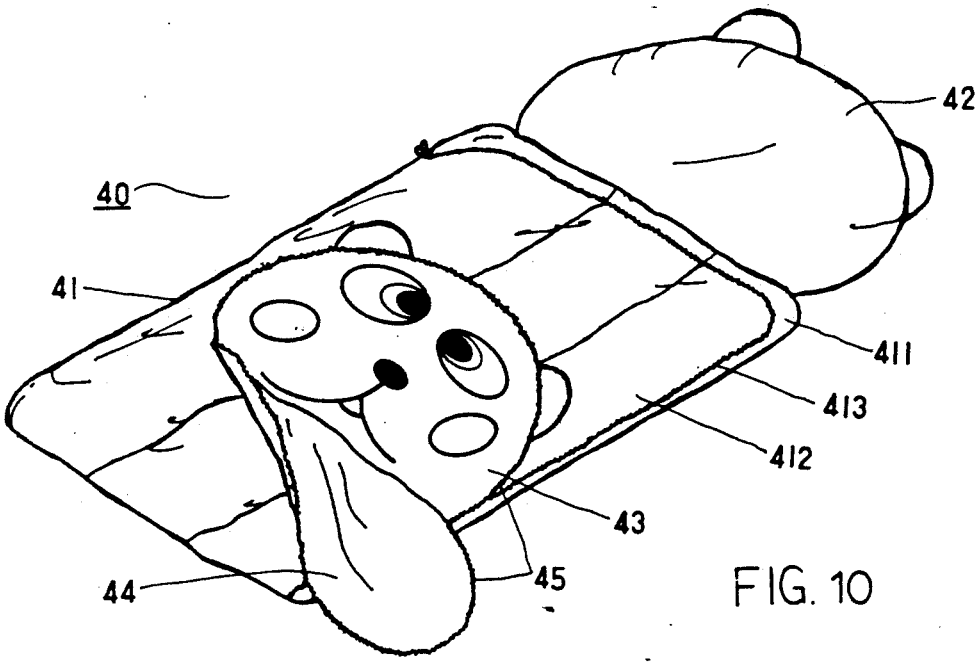
FIG. 10 is a perspective view of a fourth embodiment of the invention in its extended condition.

The fourth embodiment of the present invention comprises a bag for packing a sleeping bag 41. The sleeping bag 41 of this embodiment has two stacking layers 411, 412 fastened together with a zip fastener 413 and a pillow 42 attached to the front end of the sleeping bag 41. The bag of this fourth embodiment is generally referred to by numeral 40 and comprises a frontal section 43 in a form of a panda face patterned after a panda, sewn to the middle of a cover of the sleeping bag and integral with a back or flap section 44 which is equal in size to and depending from the frontal section 43. A complementary pair of slide fastener parts 45 are affixed along the margins of the frontal and flap sections 43, 44 to zip close the bag of the fourth embodiment, as shown in FIG. 10. A slider (not shown) is provided to pack the sleeping bag 41 therein in good order and with a pleasing appearance of a toy panda face.

Figure 11:
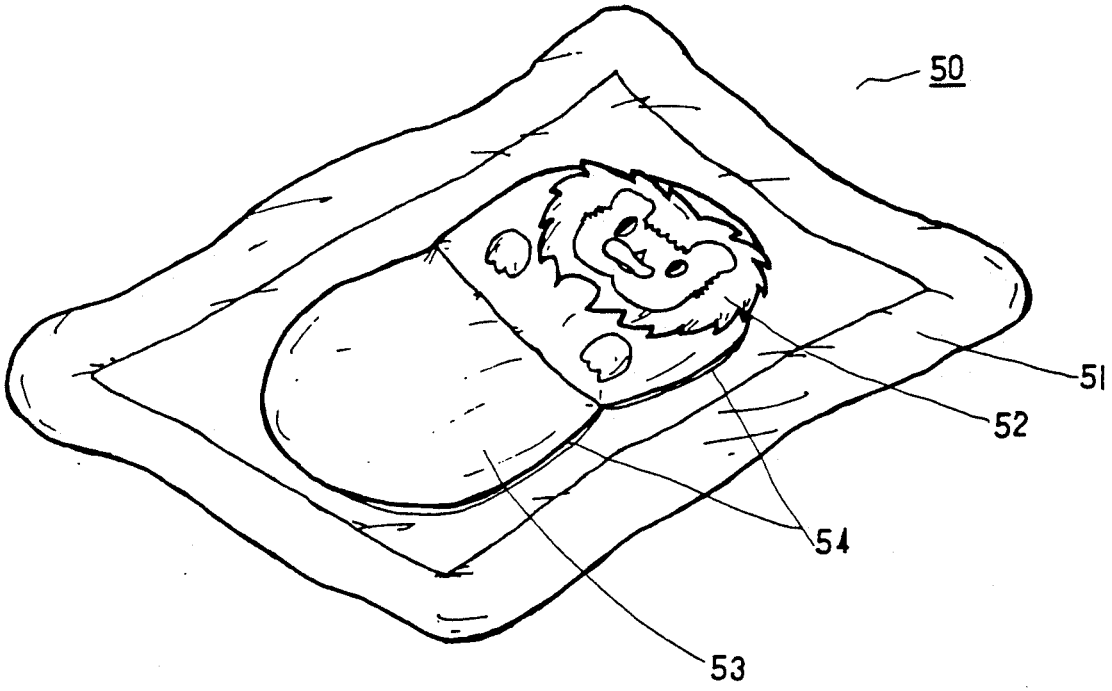
FIG. 11 is a perspective view of a fifth embodiment of the invention which is in an extended condition.

The back or flap sections 13, 23, and 44 shown in the first, second and fourth embodiments can be sewn to the covers of the quilts 11, 21 and sleeping bag 41 to form a partial envelope for packaging. Referring to FIG. 11, a quilt bag of the fifth embodiment is referred to generally by numeral 50. This bag 50 comprises a frontal section 52 in the form of a toy lion, sewn to the middle of a frontal section of a cover of a quilt 51 and integral with a back section 53 equal in size to the frontal section 52 and sewn to the middle of a rear portion of the cover of the quilt 51 and a complementary pair of slide fastener parts 54 affixed along the margins of the frontal and back sections 52, 53 to zip close the quilt bag of the fifth embodiment with a slider (not shown) so as to pack the quilt 51 therein in good order and in a lovely appearance of a lion toy.

Figure 12:
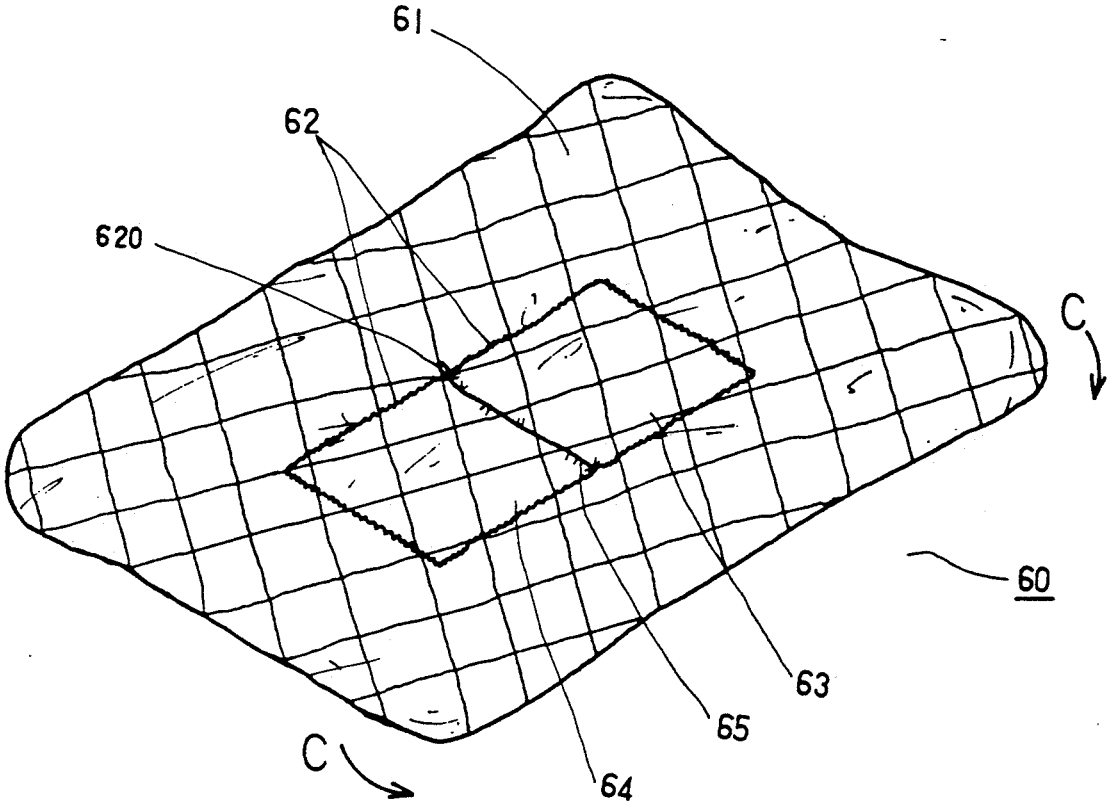
FIG. 12 is a perspective view of a sixth embodiment of the invention which is in an extended condition.
Figure 13:
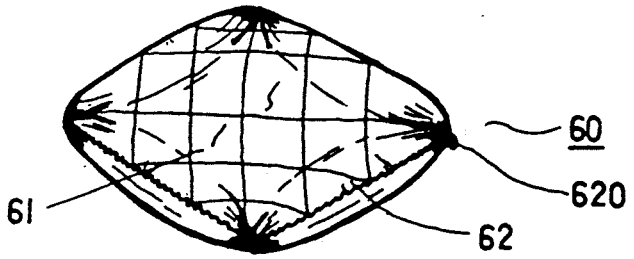
FIG. 13 is a perspective view of the sixth embodiment of the invention which is in its packed condition.

Similar to the fifth embodiment, a quilt bag of the sixth embodiment is shown in FIGS. 12 and 13 and referred to generally by numeral 60. The bag 60 comprises a conventional quilt 61 and a complementary pair of slide fastener parts 62 with one of the complementary pair of slide fastener parts affixed to a cover of the quilt 61 to define a substantially square section 63 which serves as a frontal section on the cover, and the other of the complementary pair of slide fastener parts 62 affixed to the cover of the quilt 61 to also define a substantially square section 63, which serves as a back section, equal in size and adjacent to the frontal section 63, and a crease between the frontal and back sections 63, 64. The back section 64 can be folded from the bottom or the crease 65 to form a pocket. The quilt 61 of this embodiment can be folded into the pocket and packed therein in good order by zipping closed the pocket with a slider 620. In this embodiment, the quilt 61 is folded downwardly along arrows C for being packed into a pillow or cushion as best shown in FIG. 13.

The quilt bag of the present invention enables a conventional quilt, sleeping bag or the like to be packed into a pillow or cushion with decorative patterns to serve additional functions other than a bed covering and facilitate a bed arrangement when not in use, or transportation, when necessary.

While the present invention has been described with reference to specific embodiments, the description is illustrative and is not to be construed as limiting the scope of the invention. Various modifications and changes may occur to those skilled in the art without departing the from the spirit and scope of the invention as defined by the appended claims.

I claim:

1. A quilt bag comprising a quilt having an outer surface including a middle portion, a pillow at one end thereof and a remaining portion surrounding said middle portion, a frontal cover having a first portion defining the shape of a toy-like object with an outer edge extending along the periphery of the toy-like object, said frontal cover also including an integral flap which is equal in size and shape to said first portion and which also includes an outer edge along the periphery of its toy-like shape, said frontal cover including said flap sewn to said middle portion of said outer surface and defining a crease between said first portion and said flap so that said flap can be folded over said first portion along said crease to bring the peripheral edge of said first portion and said flap into registry with one another to thereby form an envelope and with the remaining portion of said quilt folded therebetween and completely encased together with said pillow within, a complementary pair of slide fastener parts fixed to said outer edges of said first portion and said flap and a slider for fastening said slide fastener parts together to thereby form a completely closed bag with the remaining portion of said quilt and said pillow folded therein.

* * * * *